US007044893B2

(12) United States Patent
Tsai

(10) Patent No.: US 7,044,893 B2
(45) **Date of Patent: *May 16, 2006**

(54) WALK SIMULATING MACHINE

(75) Inventor: Shih-Chang Tsai, Tainan Hsien (TW)

(73) Assignee: Tonic Fitness Technology, Inc., (TW)

( * ) Notice: Subject to any disclaimer, the term of this patent is extended or adjusted under 35 U.S.C. 154(b) by 52 days.

This patent is subject to a terminal disclaimer.

(21) Appl. No.: 10/821,880

(22) Filed: Apr. 12, 2004

(65) Prior Publication Data

US 2005/0227815 A1 Oct. 13, 2005

(51) Int. Cl.
*A63B 69/16* (2006.01)
*A63B 22/04* (2006.01)

(52) U.S. Cl. ..... 482/52; 482/51; 482/57

(58) Field of Classification Search ..... 482/51–53, 482/57, 70, 79–80

See application file for complete search history.

(56) References Cited

U.S. PATENT DOCUMENTS 5,971,892 A * 10/1999 Lee ..... 482/52
6,368,252 B1 * 4/2002 Stearns ..... 482/52
6,485,395 B1 * 11/2002 Stearns et al. ..... 482/57
6,569,061 B1 * 5/2003 Stearns et al. ..... 482/52

* cited by examiner

*Primary Examiner*—Stephen R. Crow
(74) *Attorney, Agent, or Firm*—Bacon & Thomas PLLC

(57) ABSTRACT

A walk simulating machine includes two pedal connect rods, a horizontal rod, two side connect rods consisting of an upper and a lower connect rod, and a stop member in front of each upper connect rod. The lower connect rods sway together with the pedal connect rods. The upper and the lower connect rods sway straight if the upper connect rods not stopped by the stop member; the lower connect rods solely sway if the upper connect rods stopped. So the walking orbit of the pedals may have different centers in the two different conditions. The front end portion of the walking orbit bends up, letting the heels land on the ground first for a user to stand stably. Further, a slope adjuster is provided to adjust the angle of the stop members relative to the upper connect rods for making three modes of exercise.

4 Claims, 11 Drawing Sheets

WALK SIMULATING MACHINE

BACKGROUND OF THE INVENTION

1. Field of the Invention

This invention relates to a walk simulating machine, particularly to one having pedals to move in a orbit a little different from that of an egg-shaped oval shape made by a conventional walk simulating machine, not to let the body of a user to incline to the front side as in the conventional walk simulating machine so that a user may use the walk simulating machine for bodily exercise in a stable posture without falling off the machine.

2. Description of the Prior Art

A conventional walk simulating machine generally have an orbit of egg-shaped oval shape for movement of the pedals for the feet of a user to push, as shown in FIG. 1, with a comparatively pointed front portion and a comparatively dull circular rear portion (the front half portion of the walking orbit being inclining downward.) When a user treads the pedals to let the pedal connecting rod to extend upward, the body of the user may incline forward similarly to become unstable because of the center of gravity. In order to avoid inclining forward, the user may put the center of gravity on the fingers of the feet. The walking mode with the center of gravity placed on the foot fingers is different from that of common walking mode. Moreover, walking with the center of gravity on the feet fingers for a certain period of time may harm the foot or produce cramp. So the conventional walk simulating machine is not so proper for walking exercise from the viewpoint of ergonomics.

SUMMARY OF THE INVENTION

This invention has a purpose of offering a walk simulating machine provided with pedals to move in such an orbit that a front end portion of the orbit bends up a bit so a user's heel may land the ground first (with the center of gravity located at the heel) when a foot moves forward. Thus, a user can train walking with the center of gravity stable, and the walking orbit may conform to ergonomics.

The main feature of the invention is two pedal connect rods, and two side connecting rods fixed respectively at two sides of a horizontal rod and respectively consisting of an upper connect rod and a lower connect rod pivotally connected with each other. Further, a stop member is provided in front of each upper connect rod, and the lower ends of the lower connect rods are pivotally connected with the pedal connect rods to sway back and forth together with the pedals fixed with the pedal connect rods. The upper and the lower connect rods sway straight synchronously when the upper connect rod does not collide with the stop members, and the lower connect rods only sway solely when the upper connect rods collide with and are stopped by the stop members. Therefore, the walking orbit that the front ends of the pedal connecting rods form is different in the two conditions just mentioned so the walking orbit may have the front end portion bending up a little, letting a user of the machine may exercise walking stably, with the heels of the feet landing on the ground first, conforming to ergonomics.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
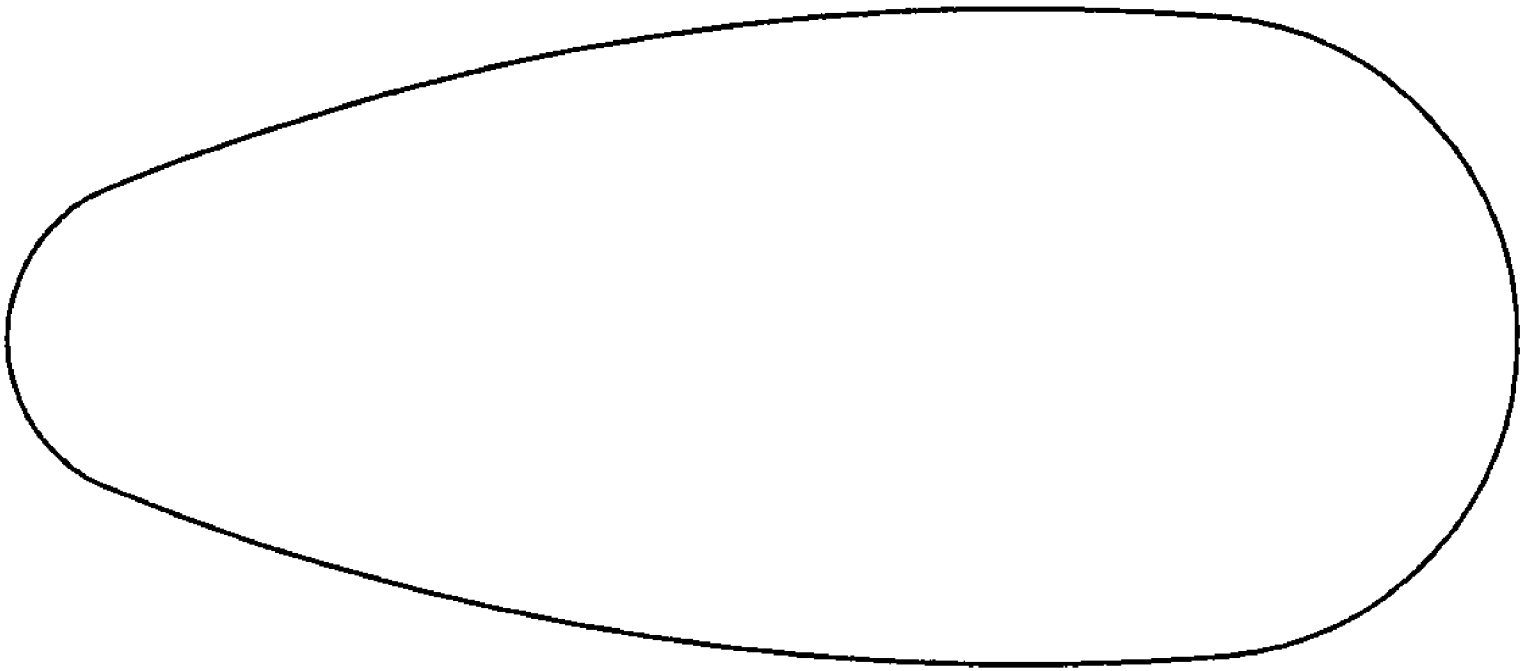
FIG. 1 (PRIOR ART)
FIG. 1 is a perspective view of a moving orbit generated by a conventional walk simulating machine.
Figure 2:
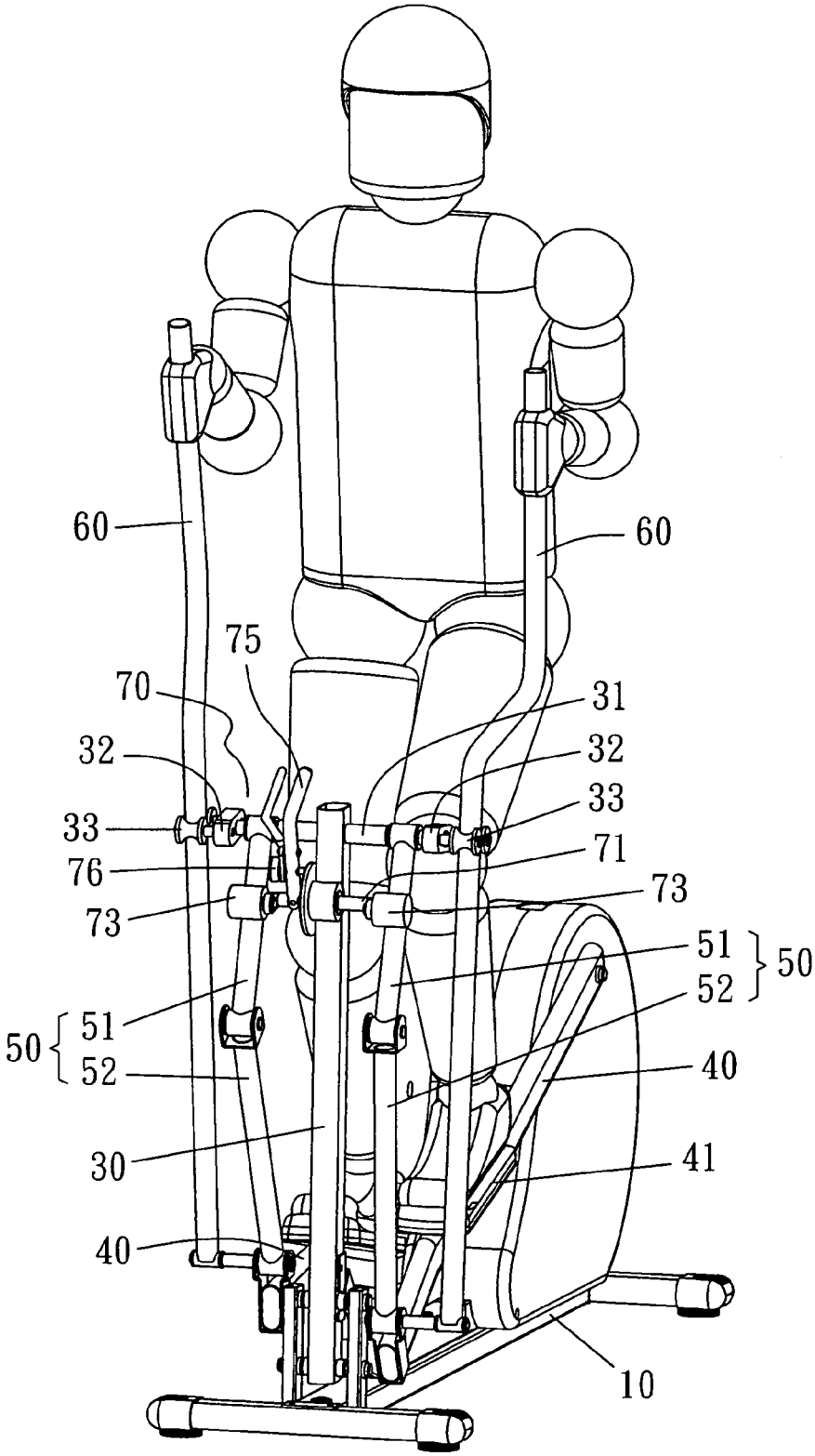
FIG. 2 is a perspective view of a walk simulating machine in the present invention.
Figure 3:
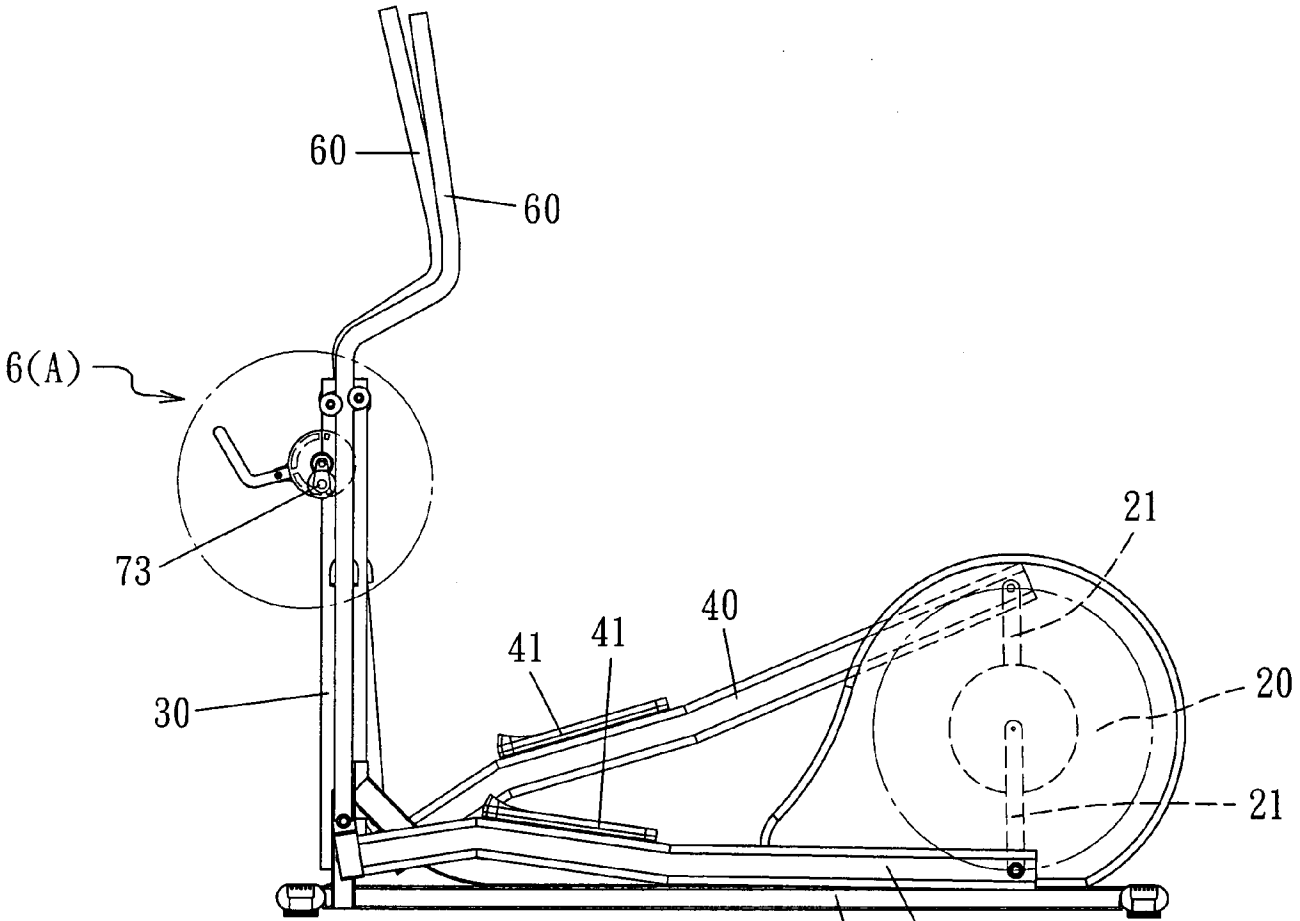
FIG. 3 is side horizontal view of the walk simulating machine in the present invention.

A preferred embodiment of a walk simulating machine in the present invention, as shown in FIGS. 2 and 3, includes a base 10, a crank unit 20, a front post 30, two pedal connecting rods 40, two side connect rods 50, two connect rods 60, and a slope adjuster 70 as main components combined together.

The base 10 is to be laid on the ground to support the other components just mentioned above.

The crank unit 20, as shown in FIG. 3, is located on a rear portion of the base 10, having two cranks 21 respectively connected pivotally at two sides. The two cranks 21 are positioned at 180 degrees' difference.

Figure 4:
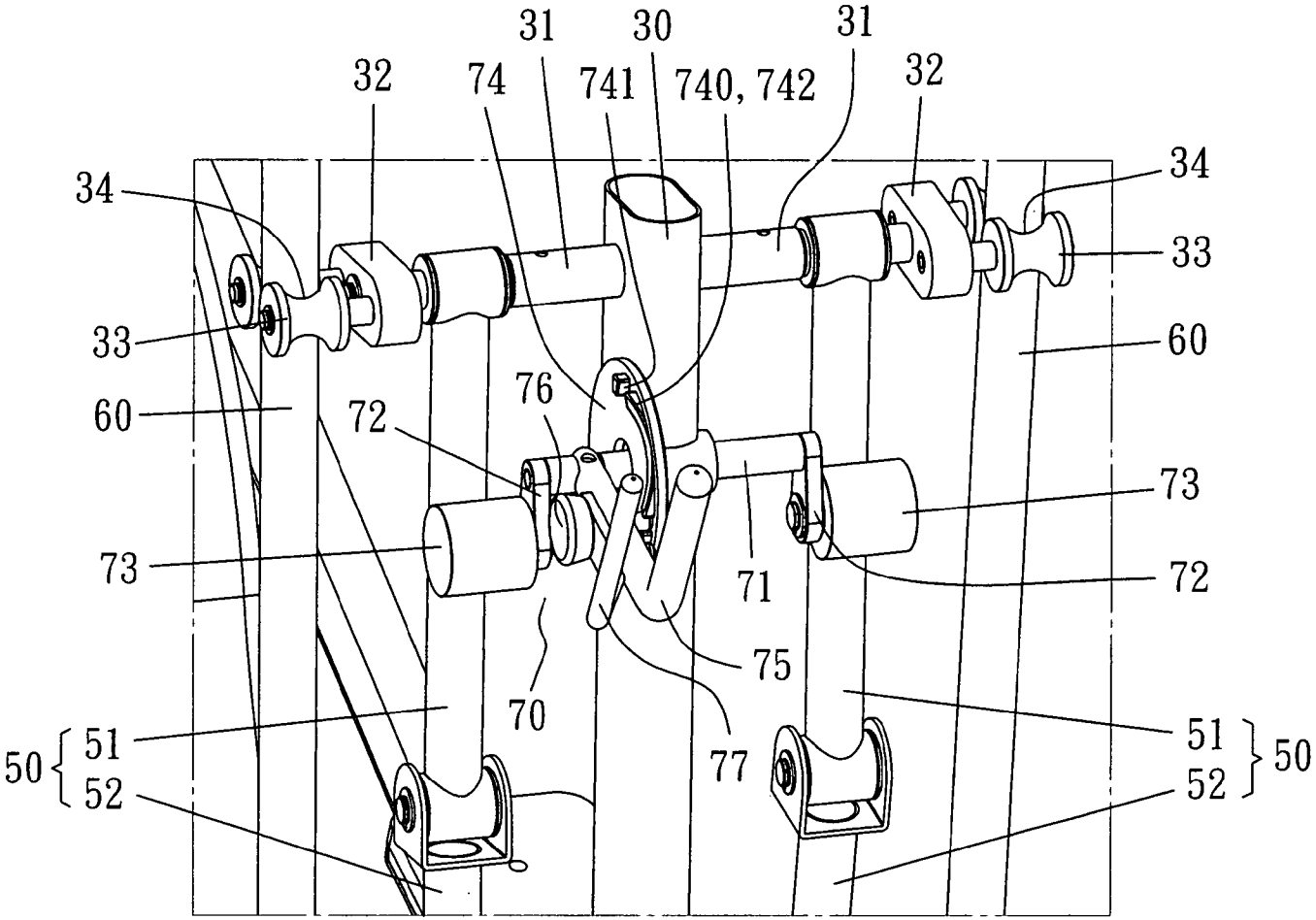
FIG. 4 is a partial front view of the walk simulating machine in the present invention.

The front post 30 is fixed on a front end of the base 10 extending upward, having a horizontal rod 31 extending to two sides from the upper end as shown in FIGS. 2 and 4. The front post 30 further has two roller supporting members 32 respectively at two outer sides, and two slide rollers 33 respectively at the outer side of each roller supporting member, the rollers 32 forming an aperture 34 between them.

The two pedal connecting rods 40, as shown in FIGS. 3, are located respectively at two sides of the base 10, having the rear end connected pivotally to one end of each crank 21, and a pedal 41 fixed on an upper surface for a user's foot to tread on.

The two side connect rods 50, as shown in FIGS. 2 and 3, are located vertically respectively at the two outer sides of the front post 30, respectively consisting of an upper connect rod 51 and a lower connect rod 52 pivotally connected with each other. The upper connect rod 51 has its upper end pivotally connected to the horizontal rod 31, and the lower connect rod 52 has its lower end connected pivotally to the front end of the pedal connecting rod 40.

The two hand gripping rods 60, as shown in FIGS. 2 and 3, are located respectively at two sides of the front post 30, having their lower ends pivotally connected to the front ends of the pedal connecting rods 40, and the upper ends extending upward through the apertures 34 of the two slide rollers 33 as shown in FIG. 4, with their upper ends held by the hands of a user.

Figure 5:
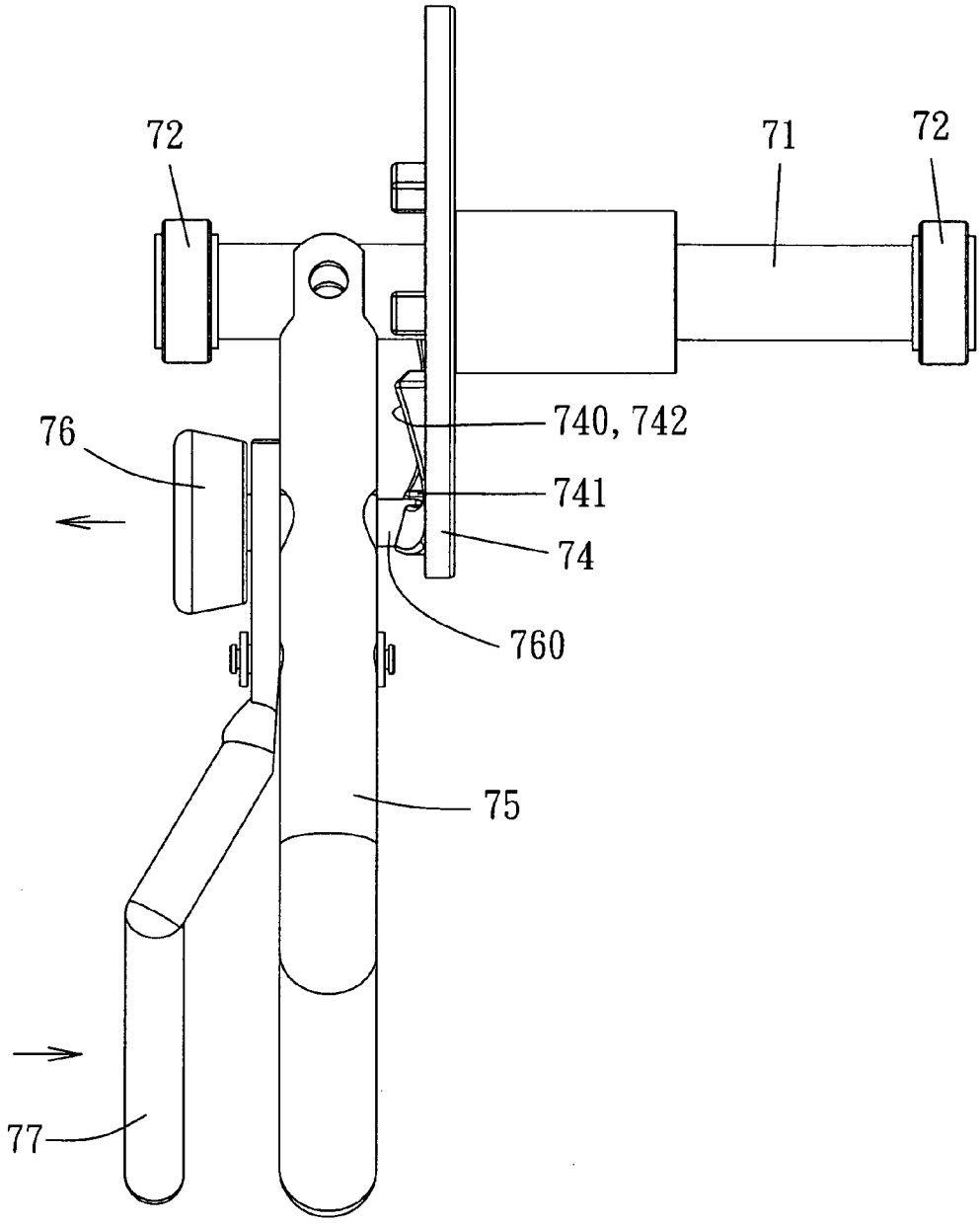
FIG. 5 is an upper view of the front portion of the walk simulating machine in the present invention.
Figure 6B:
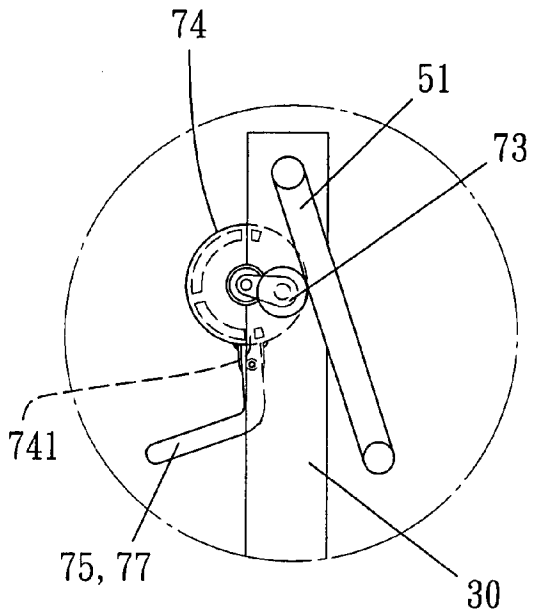
FIG. 6B is a front view of the slope adjuster in a slope-up condition in the present invention.
Figure 6A:
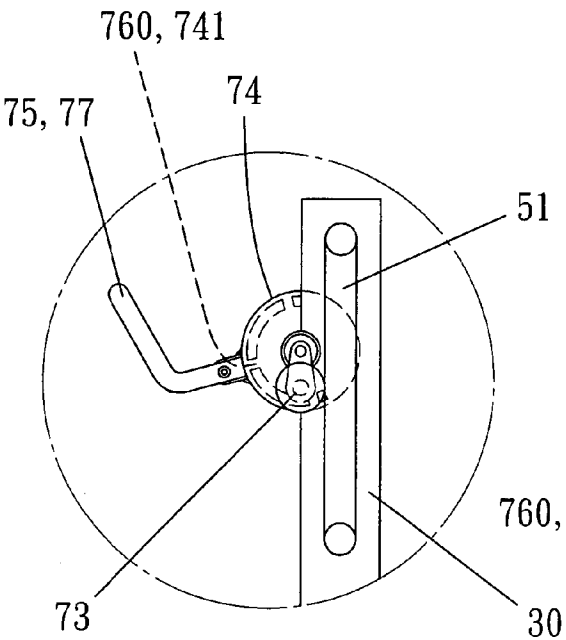
FIG. 6A is a front view of a slope adjuster in a horizontal condition in the present invention.

The slope adjuster 70, as shown in FIGS. 2 and 4, is located below the horizontal rod 31, having a slope rod 71 laterally passing through the front post 30, having two ends located at two sides of the front post 30. Two slope adjuster cranks 72 are fixed respectively at two ends of the slope rod 71, having the other ends respectively connected pivotally to two stop members (or rods) 73 located at the front of the upper connect rods 51. The slope adjuster 70 further has a position disk 74, as shown in FIGS. 4 and 6A, having one side surface fixed with a left side of the front post 30, and the other side provided with a plurality projecting curved ribs 740, a plurality of recesses 741 respectively provided alternately with the ribs 740, and an slender recess 742 formed in the curved ribs 740. Further, the slope adjuster 70 has an L-shaped adjust rod 75, as shown in FIGS. 4 and 5, and the adjust rod 75 has the upper end fixed vertically with the slope rod 71, and the lower end extending forward the front post 30, moving together with the slope rod 71. Further, the slope adjuster 70 has a locking tenon (locking pin) 76 provided with one end 760 laterally extending through the slope rod 75 and fining in one of the recesses 741 and pushed by a spring therein to shift. Moreover, the slope adjuster 70 has a push rod 77 with its intermediate section pivotally connected to the adjust rod 75, and one end fining in the gap between the adjust rod 75 and the end 760 of the locking tenon 76. When the push rod 77 is pulled to the adjust rod 75, the other end of the push rod 77 moves the end 760 of the locking tenon 76 to compress the spring therein, forcing the end 760 to separate from one of the recesses 741 as shown by the arrow in FIG. 5. In this way, the adjust rod 75 can move the slope rod 71 when pulled, with the stop rod 73 also shifted at the same time and changing the stopping angle for swinging of the upper connect rod 51. The adjust rod 75 is manually handled, but it can also be controlled electrically, for example by a motor.

In using the walk simulating machine, there are three modes described below, referring to FIGS. 2 and 3.

Figure 7:
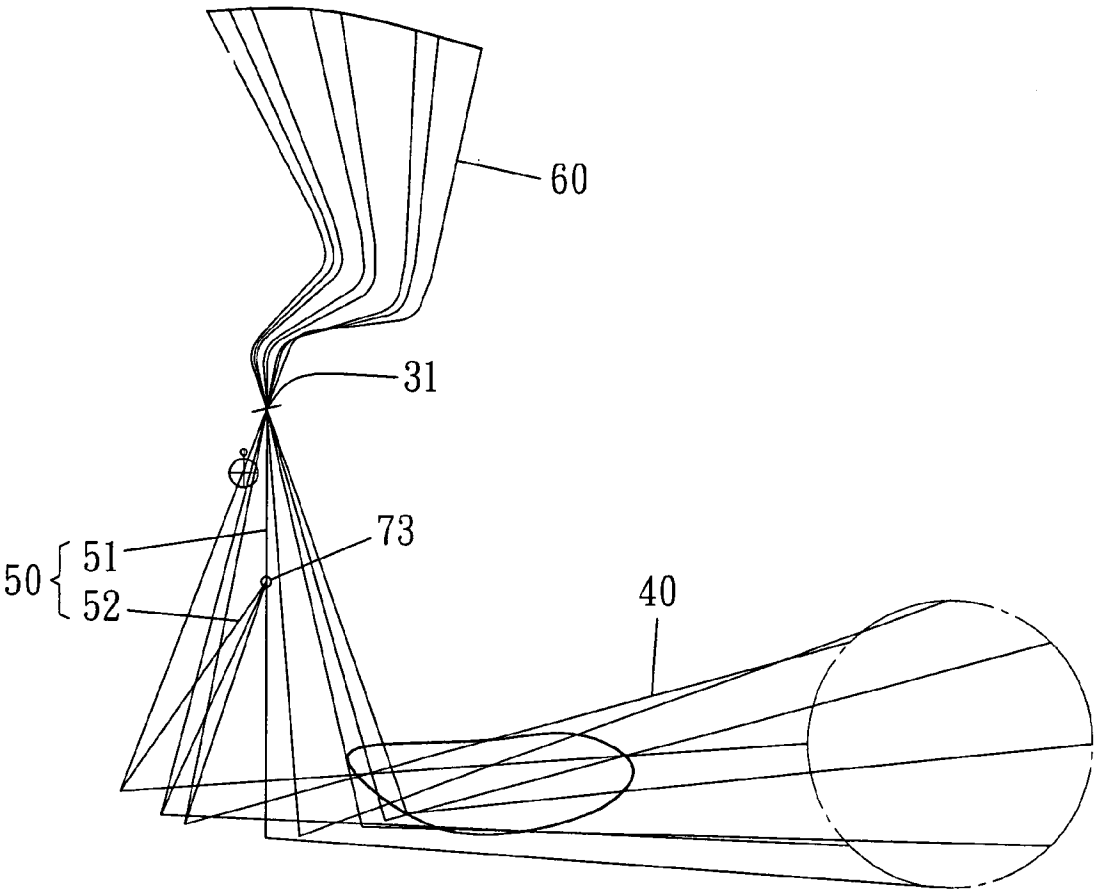
FIG. 7 is a perspective view of a walking orbit generated by the walk simulating machine in the horizontal condition in the present invention.

1. Using it in a horizontal condition. In this condition, the upper connect rod 51 is stopped by the slope adjuster 70 to position vertically as shown in FIGS. 3 and 6A. When two feet of a user stand on the pedals 41 with two hands gripping the upper ends of the hand gripping rods 60, the user moves hand gripping rods 60 to let the pedals 41 treaded by the feet move in a walking orbit shown in FIG. 7. The walking orbit is interrupted in case of the upper connect rod 51 coming to contact with the stop rod, so that the lower connect rod 52 swings together in a straight line with the upper connect rod 51 until the upper connect rod 51 contacts with the stop rod 73. At the moment the upper connect rod 51 is stopped immovable by the stop rod 73, the lower connect rod 52 may swing independently with the function of the pivotal point of the upper and the lower connect rod 51 and 52 as an orbit center, forming the walking orbit shown in FIG. 7.

Figure 8:
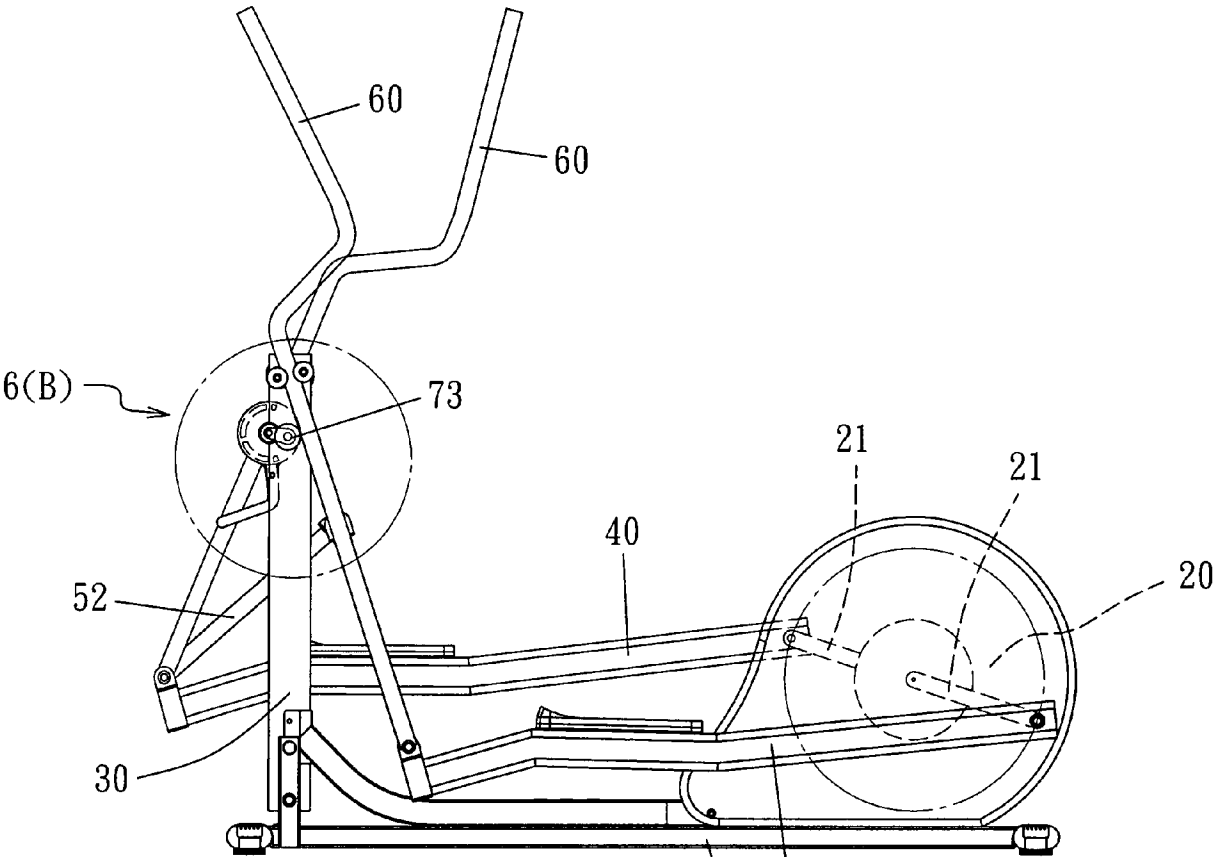
FIG. 8 is side view of the walk simulating machine with pedals moving in a sloping-up condition in the present invention.
Figure 9:
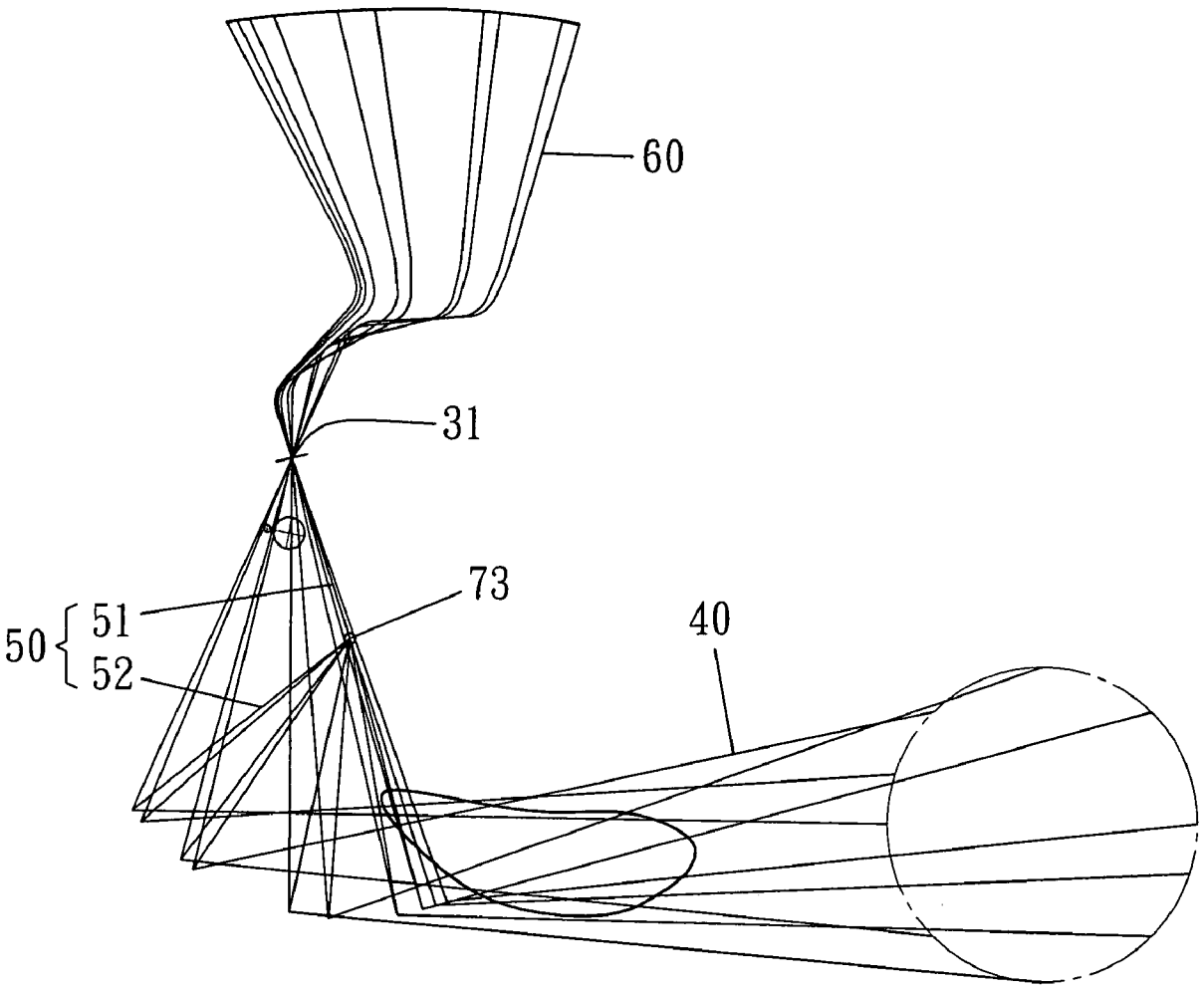
FIG. 9 is a perspective view of walking orbit generated by the walk simulating machine in a sloping-up condition in the present invention.

2. Using it in a sloping-up condition. In this condition, the stop rod 73 is moved rearward by handling the adjust rod 75 and fixed in that position. Then the walking orbit formed by the pedals 41 will be the one shown in FIGS. 8 and 6B, with the front section of the orbit bending up as shown in FIG. 9. Thus, a user can get training as if walking up a slope.

Figure 6C:
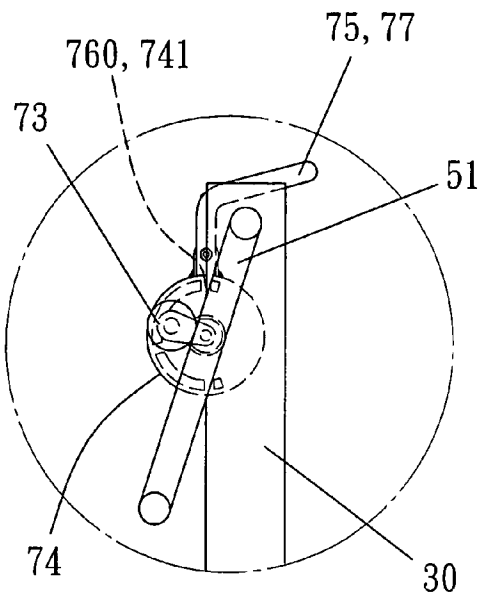
FIG. 6C is a front view of the slope adjuster in a sloped-up condition in the present invention.
Figure 10:
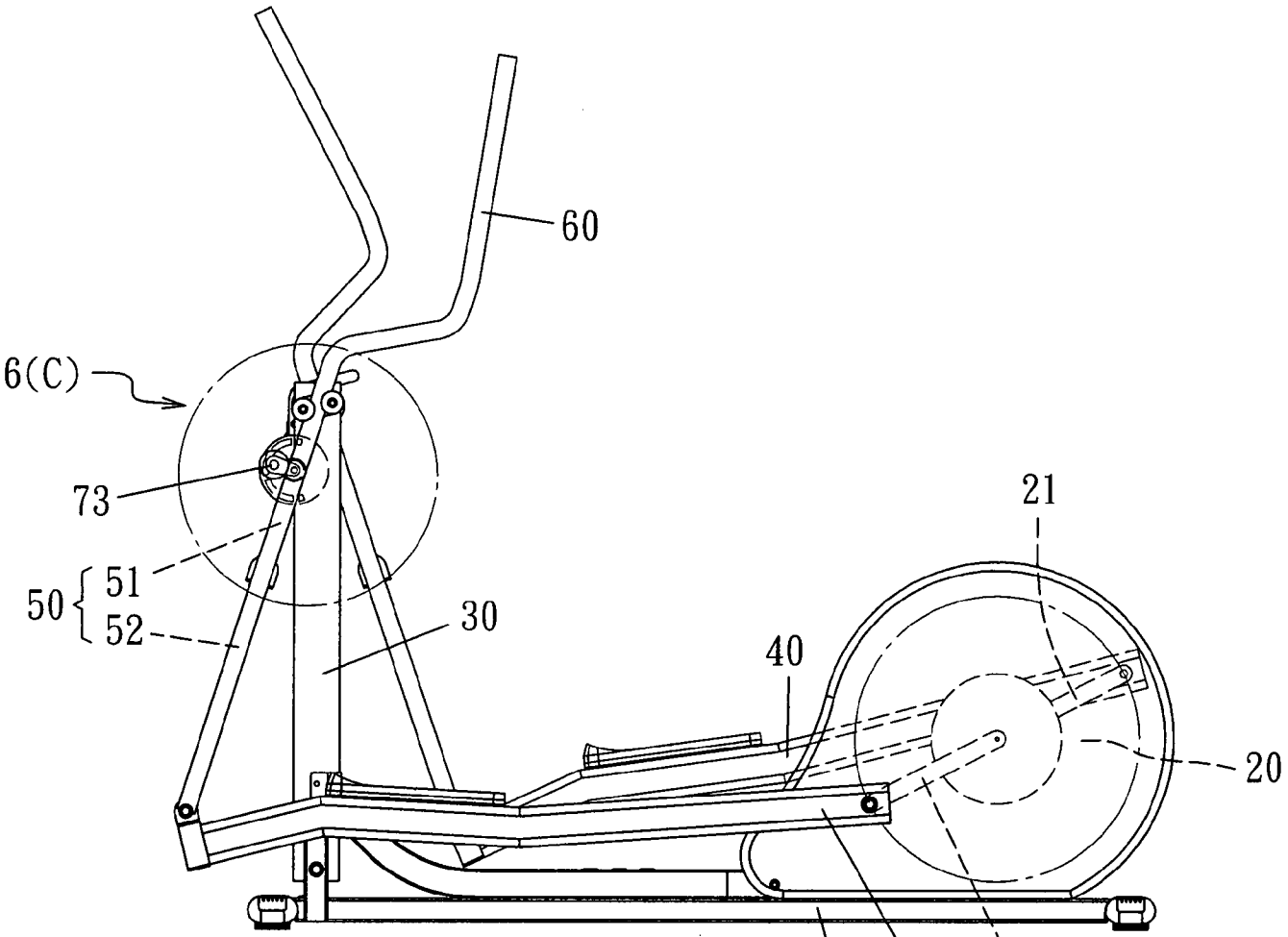
FIG. 10 is a side view of the walk simulating machine with pedals moving in sloping-down condition in the present invention; and, FIG. 11 is a perspective view of a walking orbit generated by the walk simulating machine in a sloping-down condition in the present invention.
Figure 11:
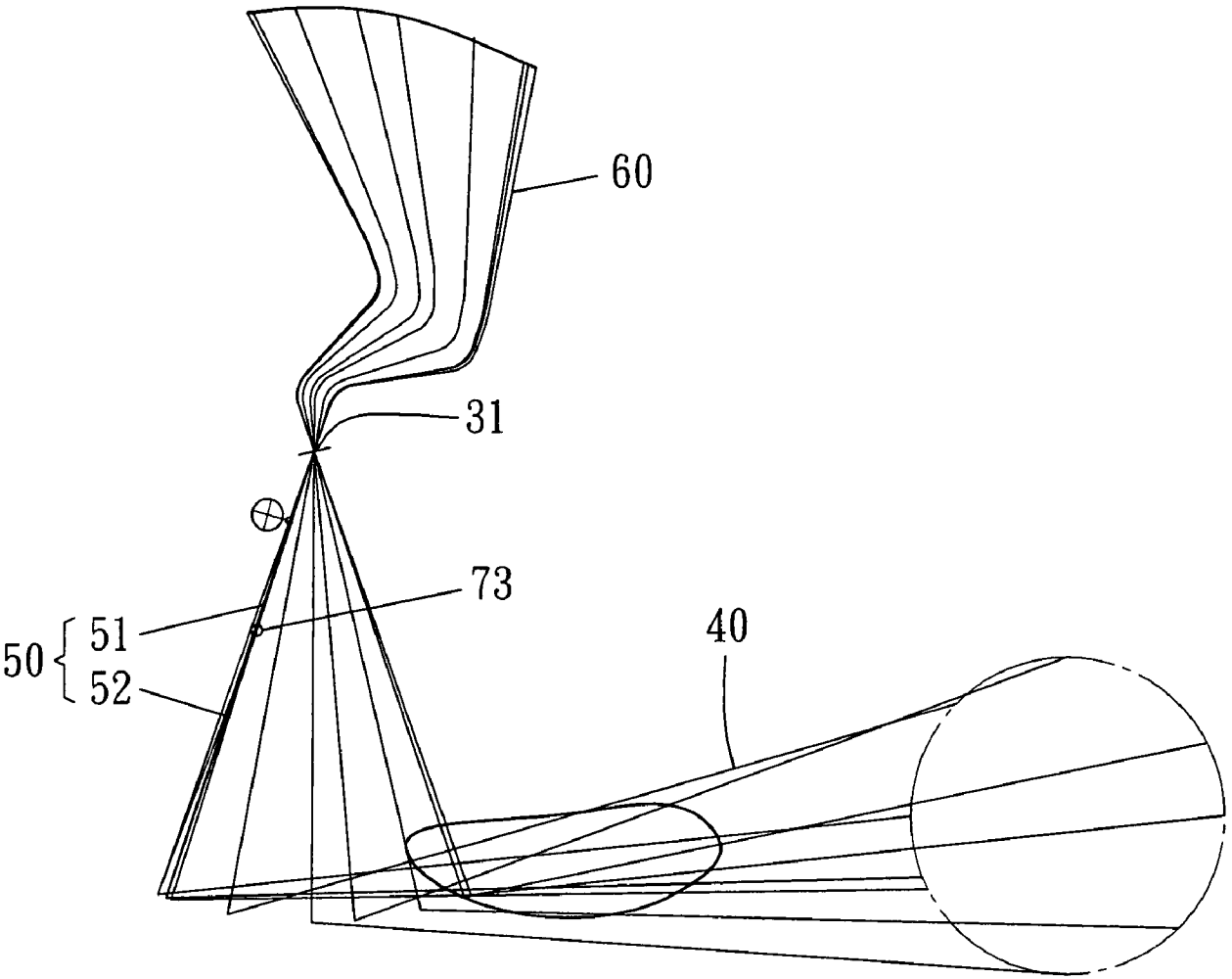

3. Using it in a sloping-down. In this condition, the stop rod 73 is moved forward and secured stably in that position as shown in FIGS. 6C and 10. Then the walking orbit of the pedals 41 has its front end sloping down, as shown in FIG. 11, and a user can use the walking simulating machine for training of walking down a slope.

As the upper connect rod 51 has a stage of swaying and a stage of stopping by means of the stop rod 73 located in front of the upper connect rod 51, so the center of the walking orbit of the lower connect rod 52 during the straight movement is different from that during non-straight line movement. Therefore the walking orbit formed by the pedals 41 may have its front end portion bending up a little, forcing the user to land on the ground with his heels first when training walking in this condition, with the user's posture being in a stable condition conforming to ergonomics. Furthermore, in the sloping-up and the sloping-down condition of the walking simulating machine, the walking orbit formed by the pedals 41 is also the same as the horizontal condition, with the front end portion bending up a little, obtaining better function than the conventional walking simulating machine. In addition, when the sloping-up angle is adjusted to the largest, the upper connect rod 51 has no swaying stage, while the lower connect rod 52 has a swaying stage. On the contrary, when the sloping-down angle is adjusted to the largest, the upper and the lower connect rod 51 and 52 sway synchronously in the whole orbit.

Lastly, referring to FIG. 9, as the upper end of the hand connect rod 60 moves in an S shape in the walking orbit, it is easy for the user to use more manual force.

While the preferred embodiment of the invention has been described above, it will be recognized and understood that various modifications may be made therein and the appended claims are intended to cover all such modifications that may fall within the spirit and scope of the invention.

What is claimed is:

1. A walk simulating machine comprising:

a bases;

a crank unit fixed on an upper rear portion of said base and having two cranks respectively pivotally connected with opposite sides of the crank unit, said two cranks located with an angular difference of 180 degrees therebetween;

a front post fixed on and extending upward from a front end of said base, the front post having a horizontal rod extending to the right side and the left side of the front post, two roller supporting members respectively connected at two outer ends of said horizontal rod;

two pedal connect rods located respectively at two sides of said base, respectively having their rear ends pivotally connected with said cranks of said crank unit each pedal connect rod having a pedal fixed thereon;

two side connect rods respectively located at two sides of said front post and respectively consisting of an upper connect rod and a lower connect rod, said upper connect rod having its lower end pivotally connected with an upper end of said lower connect rod, said upper connect rod having its upper end pivotally connected with said horizontal rod, a stop member located at the front of said upper connect rod, said upper connect rod having a swaying stage and a not-swayable stage set by said stop member in case said upper connect rod is stopped by said stop member, said lower connect rods having its lower ends pivotally connected with front ends of said pedal connect rod; and two hand gripping rods respectively located at two sides of said base, respectively having a lower end pivotally connected with a front end of each said pedal connect rod and an upper end extending through an aperture between two slide rollers of said roller supporting member.

2. The walk simulating machine as claimed in claim 1, wherein said stop members are controlled by a slope adjuster, which moves and adjusts said stop members relative to said upper connect rods so that the swaying stage and the not-swaying stage of said upper connect rod can be adjusted, and therefore such that a walking orbit of said pedals can be adjusted into three modes for making a horizontal, a sloping-up or a sloping-down pedaling exercise.

3. The walk simulating machine as claimed in claim 2, wherein said slope adjuster includes a slope rod passing horizontally through said front post below said horizontal rod, two slope adjuster cranks respectively fixed at two ends of said slope rod, each said slope adjuster crank being pivotally connected with one of said stop members to locate said stop members in front of each said upper connect rod respectively, a position disk having one surface fixed with said front post and the other surface provided with a plurality of angle recesses spaced apart to have angle differences, an L-shaped adjust rod having its upper end fixed with said position disk, a locking pin having one end laterally passing through said adjust rod and fitting in one of said angle recesses of said position disk and having a spring to elastically push the end to securely fit in one of said angle recesses, and a push rod having its intermediate portion pivotally connected with said adjust rod and its one end extending in the connect point of said locking pin and said adjust rod, said push rod pushed to control the end of said locking pin to retreat form one of said angle recesses for changing the position of said stop rod.

4. The walking simulating machine as claimed in claim 3, wherein said slope adjuster has the slope rod laterally passing horizontally through said front post below said horizontal rod; and an electric control device is provided to drive said slope rod to shift to set a biasing angle of said slope rod so as to control a position angle of said stop member relative to said upper connect rods.

* * * * *